United States Patent [19]

Ward

[11] 4,141,530

[45] Feb. 27, 1979

[54] PLATFORM ROCKING CHAIR SPRINGS

[75] Inventor: Gene R. Ward, Saint Paul, Minn.

[73] Assignee: Minnesota Mining and Manufacturing Company, Saint Paul, Minn.

[21] Appl. No.: 786,487

[22] Filed: Apr. 11, 1977

Related U.S. Application Data

[63] Continuation-in-part of Ser. No. 727,650, Sep. 29, 1976, abandoned.

[51] Int. Cl.[2] ..... A45D 19/04

[52] U.S. Cl. ..... 248/629; 297/300; 248/618; 248/632

[58] Field of Search ..... 248/387, 392, 425; 297/264, 300, 302; 267/133, 149

[56] References Cited

U.S. PATENT DOCUMENTS

| | | | |
|---|---|---|---|
| 107,924 | 10/1870 | Lamb | 297/300 |
| 183,366 | 10/1876 | Born | 297/264 |
| 955,220 | 4/1910 | Stewart | 248/387 |
| 2,068,996 | 10/1937 | Smith | 248/387 X |
| 2,360,428 | 10/1944 | Larsen et al. | 248/392 X |
| 2,537,071 | 1/1951 | Lukins | 297/300 X |
| 2,802,514 | 8/1957 | Ninde | 297/300 X |
| 2,828,801 | 4/1958 | Papst | 248/392 |
| 2,916,084 | 12/1959 | Bottemiller et al. | 248/425 X |
| 2,969,971 | 1/1961 | Nelson | 267/149 |
| 3,070,343 | 12/1962 | Gariepy | 248/425 UX |

FOREIGN PATENT DOCUMENTS

| | | | |
|---|---|---|---|
| 756260 | 9/1933 | France | 297/300 |
| 767117 | 4/1934 | France | 297/300 |
| 27589 | 1/1907 | Sweden | 248/387 |

*Primary Examiner*—Lawrence J. Staab

*Attorney, Agent, or Firm*—Cruzan Alexander; Donald M. Sell; Robert E. Granrud

[57] ABSTRACT

A platform rocking chair is provided by mounting a chair seat to a platform solely by a pair of flat fiber-reinforced springs extending from the sides of the platform to the sides of the chair seat. The rocker blocks employed in many platform rockers are eliminated.

9 Claims, 6 Drawing Figures

PLATFORM ROCKING CHAIR SPRINGS

CROSS REFERENCE TO RELATED APPLICATION

This application is a continuation-in-part of applicant's copending application Ser. No. 727,650, filed Sept. 29, 1976, now abandoned.

BACKGROUND OF THE INVENTION

A typical platform rocking chair has a pair of curved rocker blocks which are integral with the seat box and ride on a pair of rails which are integral with the platform. Brackets attached to the rails and rocker blocks retain a pair of coil springs at each side of the chair which control the rocking action. Ideally the springs provide an easy, yet restricted rocking action, but when selected for a person of average weight, a heavier person may cause the chair to rock too violently and possibly overturn. Even so, a person of light weight might consider the same rocking chair to be too stiff for comfort.

After a period of use, the springs and/or their brackets may fail due to fatigue or shock. If they do not fail, the spring rate changes to result in excessive rocking action. In any event, the springs eventually become noisy unless lubricated. If lubricated, the lubricant may stain the rug or floor beneath the chair.

Unless the rocker blocks are constructed and positioned with precision, the chair may have a rough rocking action. If the spring brackets are not located with precision or if the coils are not properly adjusted, there may be a discontinuity in the rocking action and/or the unoccupied chair may rest at an angle which is esthetically undesirable.

THE PRESENT INVENTION

The present invention concerns spring means for mounting a chair seat on a platform to function as a platform rocking chair, eliminating the need for rocker blocks while providing extraordinarily smooth, reliable, quiet rocking action. While being readily manufactured to provide a rocking action of exacting stiffness, a simple adjustment is available to provide either stiffer or easier rocking action. Unless adjusted, the rocking action should not change, even after years of normal use. The novel rocking chair spring means comprise:

(a) a pair of substantially straight flat fiber-reinforced plastic springs, each of which may include a single leaf or multiple leaves and (b) brackets attaching one end of each of the pair of springs to a side of the platform and the other end centrally to a side of the seat box or other lateral support for the chair seat such that the springs provide the sole support for the chair seat.

In some cases a better ride can be obtained by adding (c) a pair of bumpers fixed either to the platform or to a lateral support for the chair seat, each of which extends across the rear of one of the springs, which bumpers are simultaneously contacted by the springs when the chair seat is rocked backward to increase the effective stiffness of the springs and retard excessive rearward rocking action and (d) a second pair of bumpers fixed in the same manner to extend across the fore of the springs, which bumpers are simultaneously contacted by the springs when the chair is rocked forward to increase the effective stiffness of the springs to retard excessive forward rocking action.

Preferably the bumpers are so positioned as to allow the chair to move through about 10–20% of its maximum rocking path without the springs contacting either the fore or rear bumpers. This tends to permit a modest degree of nearly effortless rocking action that should please persons of light weight. After the bumpers are contacted, the effective stiffness of the springs increases to provide firmer action toward the end points of the rocking path, thus inhibiting excessive rocking movement. To provide a more gradual increase in resistance to the rocking action toward the ends of the ride, there may be two sets of bumpers, one of which may be contacted by the upper half of each spring and the other by the lower half. In a preferred adjustment, one set of bumpers is contacted by the springs at about 5–10% of the maximum rocking path and the other at about 20–30% of the maximum rocking path. To minimize stress on the springs, the distance from each bracket on the chair seat to the point at which each spring contacts one bumper pair may be 40–50% of the effective free length of the spring and to the point at which each spring contacts the other bumper pair, 65–75% of the effective free length of the spring.

Conveniently one set of bumper pairs is fixed to a side of the seat box or other lateral support of the chair seat and the other set is fixed to the platform. However, both sets may be fixed either to said lateral support or to the platform. For those who want a customized chair, the bumpers may be adjustable either to move the points of contact upwardly or downwardly along the springs or to permit greater or lesser rocking motion before being contacted by the springs. Economical adjustment of the rocking movement before the springs contact the bumpers is provided by establishing relatively large fixed spacings between the springs and bumpers when the chair is at rest and reducing the spacings by placing shims between the bumpers and the springs, e.g., by adhering pieces of tape to the bumpers.

Because the chair is suspended above the platform solely by the pair of substantially straight flat reinforced-plastic springs, each spring should have a compressive strength of at least 350,000 kPa and a flexural strength of at least 350,000 kPa in the lengthwise direction. For good, general-purpose rocking action, the lengthwise flexural modulus should be from 13 to 55 $\times$ $10^6$ kPa and the effective free length of the springs should be from 6 to 20 cm, preferably 8 to 12 cm. At effective free lengths less than 8 cm, the flexural modulus preferably approaches 13 $\times$ $10^6$ kPa and at effective free lengths exceeding 12 cm, the flexural modulus preferably approaches 55 $\times$ $10^6$ kPa. If the effective free length were less than 6 cm, the springs might fail prematurely. If the effective free length were greater than 20 cm, this would tend to raise the chair seat to an undesirably high level and would also involve undesirable lateral instability. Regardless of its length, the width of each spring should be at least four times its thickness to enhance lateral stability. Hence, the springs may be called flat springs, although their cross-section may be of oval or other shape.

The springs may be mounted to extend substantially vertically or at an angle up to about 60° to the vertical when the chair is unoccupied, and the points of their attachment to the chair seat may be either fore or aft of the points at which they are attached to the platform. When the platform includes a swivel mechanism, vertically extending springs might result in an undesirably high seat. By fixing the springs to extend at an appreciable angle to the vertical, the seat level can be appreciably lowered.

The effective lengthwise component of the fiber reinforcement of the springs should be 50–95%, and there should be a crosswise fiber reinforcement component of at least 5%, preferably located near the surface of the springs, to prevent the springs from splitting under torsional stress such as may be incurred when a person seats himself from an angle to the rocking direction. A crosswise fiber reinforcement component of 10–25% is preferred to guard against exceptionally rough treatment. The springs may comprise a plurality of layers or plies of essentially continuous, nonwoven, lineally-aligned fine glass filaments which are surrounded and exclusively bonded to each other by a restricted amount of a fusible resinous composition. The filaments may extend lengthwise in most plies and crosswise and/or obliquely in other plies.

To insure long life, the high-strength reinforcing fibers should comprise at least 30% by volume of each flat spring.

An especially preferred spring is disclosed in U.S. Pat. No. 2,969,971 (Nelson).

It should be feasible to employ pultruded reinforced plastics which have been pultruded through a slot-shaped orifice with a reinforcing fabric or mat extending the full width of the orifice.

For economy, it is preferred that each of the springs be a single leaf. If single leaves lack the desired resistance to failure, each of the pairs of springs may comprise two or more relatively thin leaves clamped or bonded together.

THE DRAWING

Figure 1:
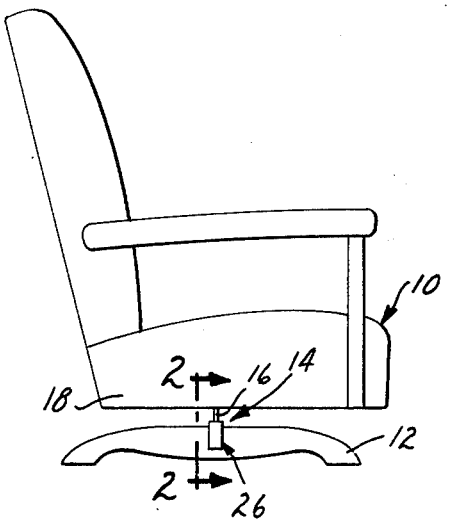
FIG. 1 is a side elevation of a platform rocking chair incorporating spring means of the invention.
Figure 2:
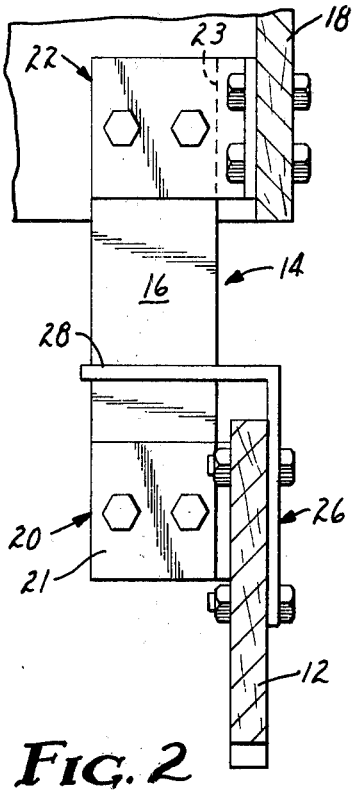
FIG. 2 is an enlarged fragmentary section along line 2—2 of FIG. 1 showing details of the spring means.
Figure 3:
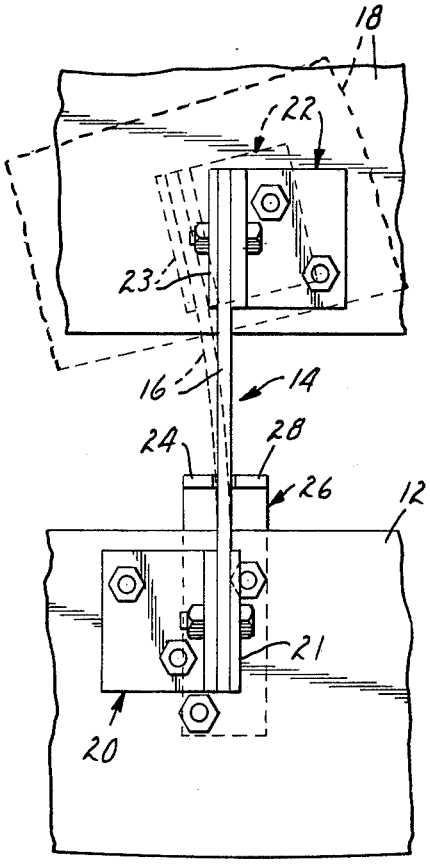
FIG. 3 is an enlarged side view (looking from the interior of the platform rocking chair) showing the spring means of FIG. 2.

Referring to FIGS. 1–3, a rocking chair 10 is mounted on a platform 12 by spring means 14 including a pair of substantially straight flat fiber-reinforced-plastic springs, one of which, 16, is shown in FIGS. 2 and 3. The flat spring 16 is bolted to the platform 12 and centrally to a side 18 of the seat box of the chair 10 by metal brackets 20 and 22, respectively. If the rocking chair 10 includes mechanism for functioning as a rocker-recliner, the spring 16 may be bolted to that mechanism.

As can be seen from FIGS. 1 and 3, the center of the effective free length of the spring 16 between metal brackets 20 and 22 should be closer to the floor than it is to the upper surface of the seat of the chair 10.

Preferably a reinforced plastic spacer (not shown) is positioned between the flat spring 16 and each of the metal pieces between which it is bolted, that is, the metal brackets 20 and 22 and the metal plates 21 and 23 which clamp the ends of the spring. The spacers should extend slightly beyond the metal pieces to prevent them from contacting and abrading the spring material.

When the seat box is rocked backwards towards the position indicated in FIG. 3 by dotted lines, the spring 16 contacts one horizontal arm 24 of a metal brace 26 which is bolted to the platform 12 and serves as a bumper. The distance from the bracket 22 and the point of contact is about 70% of the effective free length of the spring (the distance between the brackets 20 and 22). After contacting the bumper, the effective stiffness of the spring 16 increases, thus inhibiting excessive rearward rocking movement. Similarly, when the chair 10 is partially rocked forward, the horizontal arm 28 of the metal brace 26 contacts the spring 16 to increase the effective stiffness of the spring, and this inhibits excessive forward rocking movement.

The spring means 14 includes a flat spring, a pair of brackets and a brace (not shown) at the other side of the seat box which are mounted in the mirror image of the parts shown in FIGS. 2 and 3.

Figure 4:
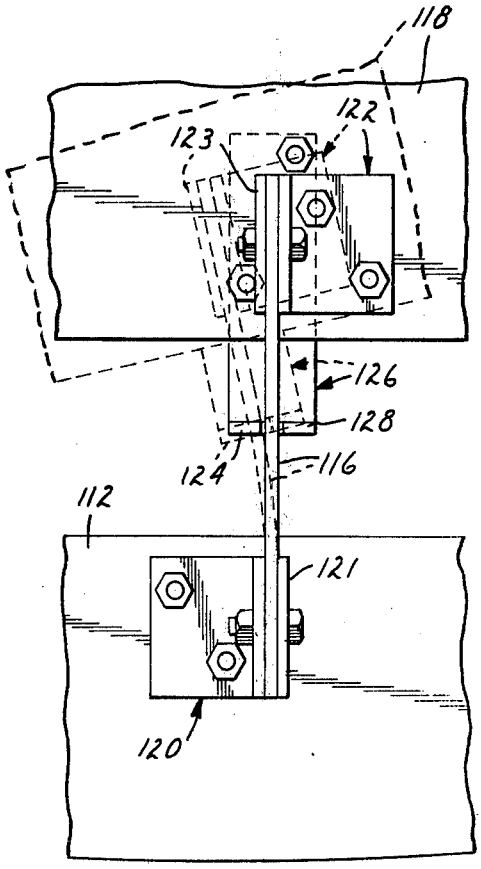
FIG. 4 is a side view of another embodiment of spring means of the invention.

In the embodiment of FIG. 4, a chair seat box 118 is mounted on a platform 112 by spring means including a pair of substantially straight flat springs, one of which, 116, is shown. The flat spring 116 is bolted to the platform 112 and to a side of the seat box 118 by brackets 120 and 122, respectively.

When the seat box 118 is rocked backwards towards the position indicated by dotted lines, the spring 116 contacts one horizontal arm 124 of a metal brace 126 which is bolted to the seat box 118 and serves as a bumper to inhibit excessive rearward rocking movement. A second horizontal arm 128 inhibits excessive forward rocking movement. The spring contacts the bumpers at a distance from the bracket 122 equaling about 45% of its effective free length.

A further degree of control of the rocking action is obtainable by mounting both metal braces 26 and 126 on the same chair, preferably positioning the bumpers so that one set is contacted by the springs before the other, as indicated above.

Figure 5:
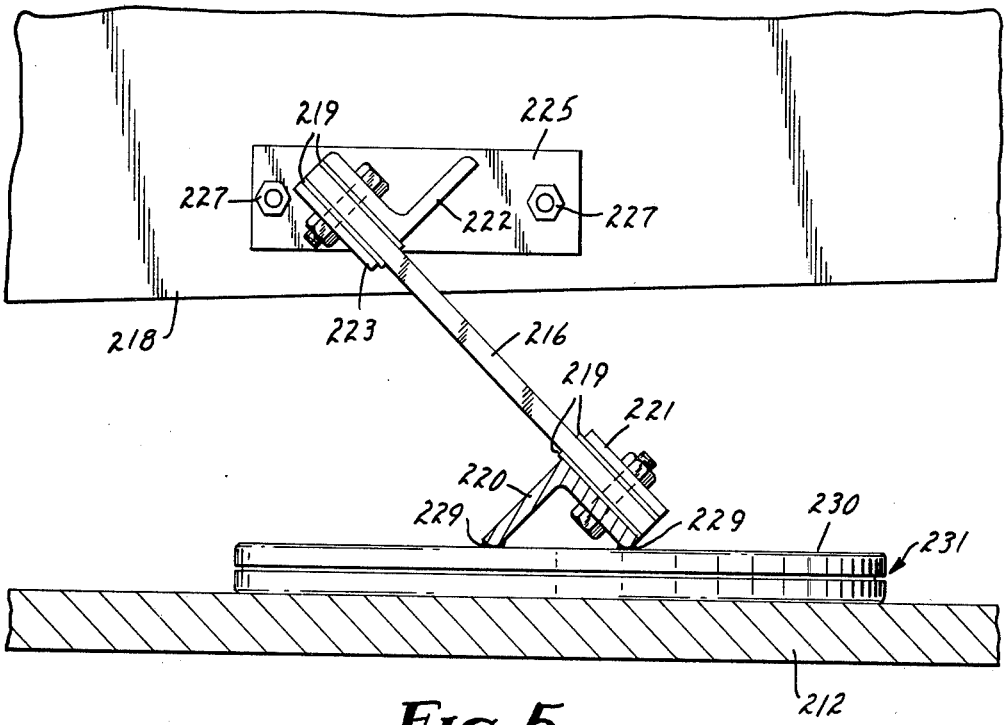
FIG. 5 is a partial central section of a platform rocking chair having a swivel mechanism and incorporating spring means of the invention.
Figure 6:
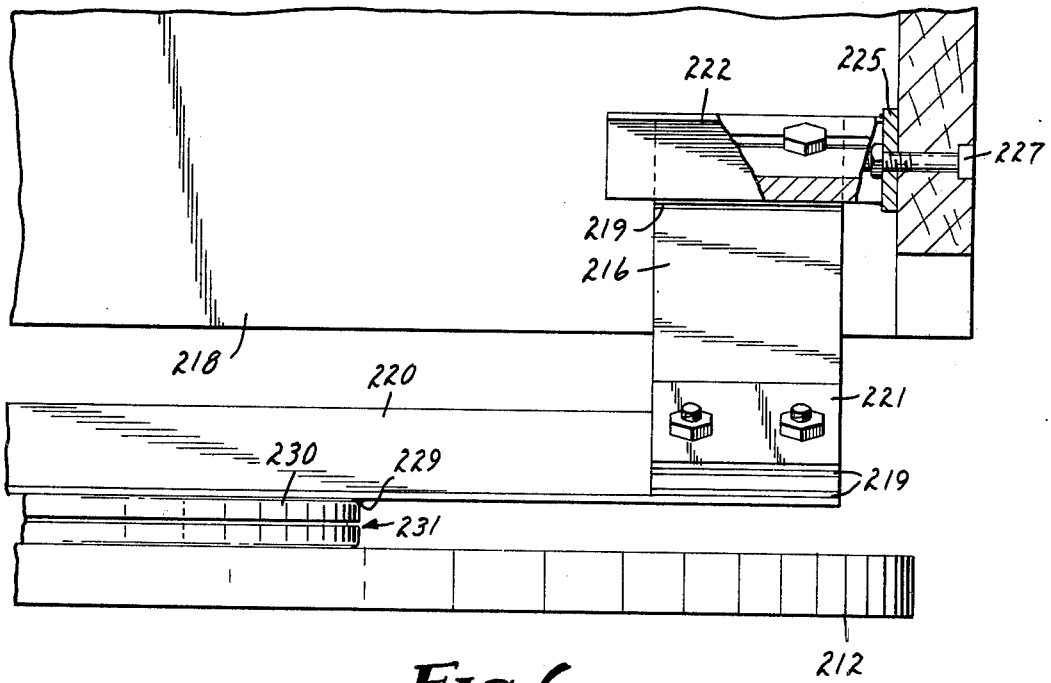
FIG. 6 is a partial view from the front of the chair shown in FIG. 5.

In the embodiments of FIGS. 5 and 6, a chair seat box 218 is mounted on a cylindrical base 212 by spring means including a pair of substantially straight flat springs, one of which, 216, is shown. The ends of the spring 216 are bolted between angle irons 220, 222 and metal plates 221, 223. Fiber-reinforced plastic spacers 219 prevent the metal pieces from contacting and abrading the spring 216. The angle iron 222 is welded to a flat steel plate 225 which is fastened by bolts 227 to a side of the seat box 218. The angle iron 220, which extends from the spring 216 to the other spring, is secured by six welds 229 across the top member 230 of a conventional swivel mechanism 231 such as that shown in U.S. Pat. No. 3,263,955 and together with the swivel mechanism provides a platform for the rocking mechanism. When the chair is unoccupied, the springs 216 extend at about 45° to the vertical. By virtue of the wide cylindrical base 212, this chair can be easily relocated as shown in FIG. 8 of U.S. Pat. No. 2,625,983. As can be seen from the FIGS. 5 and 6, the center of the effective free length of the spring 216 between the angle irons 220 and 222 is closer to the floor than it is to the upper surface of the seat of the chair (which upper surface is above the fragmentary portion of the seat box 218 shown in the drawing).

EXAMPLE 1

A rocker-recliner chair was equipped with a pair of reinforced-plastic springs as generally illustrated in FIG. 4 except that the spring brackets were attached centrally to the recliner mechanism rather than directly to the sides of the seat box. Also, a pair of relatively small round metal washers replaced each of the rectangular metal plates 121 and 123. Hence, when the chair (with the recliner mechanism upright) was rocked backward, the effective free length of the springs 116 was essentially the distance between the brackets 120 and 122, viz., 14 cm. When the chair was rocked forward, the effective free length of the springs was somewhat greater than 14 cm. The bumper arms 124 and 128 were positioned 6-⅔ cm below the bracket 122 (7-⅝ cm above the bracket 120). Before contacting either of the bumper arms 124 and 128, the springs were able to move 4 mm in either direction from their normal position (measured at the bumper arms). Five metal shims, each 0.8 mm in thickness, were used to reduce in equal increments to zero the free travel of the springs before contacting the bumper arms. With no shim, the spring moved 1.33 cm (measured at the bottom of the bracket 122) before contacting the bumper arm and 1.9 cm to maximum deflection (seat box striking the platform).

The springs were constructed of lineally-aligned, continuous fine glass filaments which were bonded to each other by hard resinous material, viz., cured epoxy resin, as disclosed in U.S. Pat. No. 2,969,971 (Nelson). Each spring consisted of a core 19 layers of filaments extending lengthwise, a pair of cross-wraps, each of two layers of filaments extending crosswise, and a pair of lengthwise-aligned single layers at the surfaces. Each layer had the same thickness, and the total thickness was 0.65 cm. Each spring in the lengthwise direction had a flexural modulus of $27 \times 10^6$ kPa, a flexural strength of $7 \times 10^5$ kPa and a compressive strength of $6 \times 10^5$ kPa.

When tested in the backward rocking direction, the following data was obtained.

| Spring-bumper spacing (mm) | Spring deflection at bumper contact (mm) | Force on each spring: at bumper contact (kg) | Force on each spring: at full deflection (kg) | Stress at full deflection: At bracket 120 (kPa) | Stress at full deflection: At bumper (kPa) |
|---|---|---|---|---|---|
| 4 | 13.3 | 54.9 | 122 | 180,000 | 144,000 |
| 3.2 | 10.7 | 43.8 | 142 | 206,000 | 167,000 |
| 2.4 | 8.0 | 33.0 | 162 | 236,000 | 191,000 |
| 1.6 | 5.3 | 22.0 | 182 | 265,000 | 215,000 |
| 0.8 | 2.7 | 10.9 | 203 | 294,000 | 239,000 |
| 0 | 0 | 0 | 223 | 323,000 | 263,000 |

The foregoing stress values are well within the ultimate capabilities of the spring material, indicating that the springs should be able to withstand many years of useful service without failure, even at zero normal spring-bumper spacing. Hence, all five shims could be safely inserted to inhibit the rocking action and any tendency of the seat box to bump against the platform.

When the bumper arms were positioned to be contacted by the spring below its centerpoint, the stress values were significantly higher but still well within the capabilities of the spring material so that there would be no danger of failure during prolonged service.

Because of the large effective free length of the springs of this Example (14 cm), the chair did not resist twisting forces as effectively as do platform rockers of good quality in the prior art unless shims were used to provide zero normal spring-bumper spacing. In the absence of shims, it is preferred that the effective free length does not exceed 12 cm to provide good stability against torsional forces. Wider springs would provide greater torsional stability but at higher cost.

Platform rocking chairs constructed as disclosed in this Example 1 except for omission of the bumpers exhibited a smooth, quiet ride but lacked the damping when maximum travel was approached. Hence, the chair seat tended to strike the platform unless some care was taken to avoid this.

EXAMPLE 2

A swiveling platform rocker was constructed as illustrated in FIGS. 5 and 6 using the same spring material as in Example 1. As mounted, the springs 216 had a free length of about 9 cm. The springs 216 were about 6.5 cm in width as compared to 7.5 cm for the springs 116 of Example 1, such reduction being feasible due to the shorter free length of the springs 216. The rocking action was adjudged to be exceedingly smooth and quiet by persons of both heavy and light weight. In no case did the chair seat strike the platform when rocked.

What is claimed is:

1. Spring means for mounting a chair seat on a platform to function as a platform rocking chair, said spring means comprising:

a pair of substantially flat fiber-reinforced plastic springs having a lengthwise fiber-reinforcing component of 50–95% and a crosswise reinforcing component of at least 5%, brackets for fixing one end of each spring to a side of the platform and the other end centrally to a side of the seat box or other lateral support for the chair seat such that the springs provide the sole support for the chair seat, each of the flat springs having an effective free length of 6–20 cm, a width at least four times its thickness and a compressive strength of at least 350,000 kPa, a flexural strength of at least 350,000 kPa and a flexural modulus of 13 to $55 \times 10^6$ kPa in the lengthwise direction, the center of the effective free length of each spring being closer to the floor than to the upper surface of the chair seat.

2. Spring means as defined in claim 1 wherein the reinforcing fibers comprise at least 30% by volume of each flat spring.

3. Spring means as defined in claim 2 wherein the reinforcing fibers comprise continuous glass filaments.

4. Spring means as defined in claim 1 wherein the effective free length of each spring is 8–12 cm.

5. A platform rocking chair incorporating spring means as defined in claim 1.

6. A platform rocking chair as defined in claim 5 including a swivel mechanism.

7. Spring means for mounting a chair seat on a platform to function as a platform rocking chair, said spring means comprising:

a pair of substantially straight flat fiber-reinforced plastic springs having a lengthwise fiber-reinforcing component of 50–95% and a crosswise reinforcing component of at least 5%, brackets for fixing one end of each spring to a side of the platform and the other end centrally to a side of the seat box or other lateral support for the chair seat such that the springs provide the sole support for the chair seat, each of the flat springs having an effective free length of 6–20 cm, a width at least four times its thickness and a compressive strength of at least 350,000 kPa, a flexural strength of at least 350,000 kPa and a flexural modulus of 13 to 55 $\times$ $10^6$ kPa in the lengthwise direction, the center of the effective free length of each spring being closer to the floor than to the upper surface of the chair seat, and a pair of bumpers fixed either to the platform or to a lateral support for the chair seat, each extending across the rear of one of the springs, which bumpers are contacted by the springs when the chair seat is rocked backward to increase the effective stiffness of the springs and inhibit excessive rearward rocking movement.

8. Spring means as defined in claim 7 including a second pair of bumpers fixed to extend across the fore of the springs, which bumpers are contacted by the springs when the chair seat is rocked forward to increase the effective stiffness of the springs and inhibit excessive forward rocking movement.

9. Spring means as defined in claim 7 wherein the bumpers are positioned to allow the chair to move through 10–20% of its maximum rocking path without contacting the bumpers.

* * * * *